US009038736B2

(12) United States Patent
Knobloch, Jr. et al.

(10) Patent No.: US 9,038,736 B2
(45) Date of Patent: May 26, 2015

(54) WELLBORE FILTER SCREEN AND RELATED METHODS OF USE

(75) Inventors: Benton T. Knobloch, Jr., Broussard, LA (US); David J. Tilley, Franklin, LA (US); Todd J. Roy, Youngsville, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 316 days.

(21) Appl. No.: 13/574,520

(22) PCT Filed: Jan. 20, 2011

(86) PCT No.: PCT/US2011/021921

§ 371 (c)(1), (2), (4) Date: Jul. 20, 2012

(87) PCT Pub. No.: WO2011/091165

PCT Pub. Date: Jul. 28, 2011

(65) Prior Publication Data

US 2012/0292047 A1 Nov. 22, 2012

Related U.S. Application Data

(60) Provisional application No. 61/296,878, filed on Jan. 20, 2010.

(51) Int. Cl.

*E21B 31/18* (2006.01)
*E21B 27/00* (2006.01)

(Continued)

(52) U.S. Cl.

CPC ..... *E21B 27/005* (2013.01); *E21B 21/103* (2013.01); *E21B 2034/007* (2013.01); *E21B 21/12* (2013.01); *E21B 37/00* (2013.01); *E21B 41/0078* (2013.01)

(58) Field of Classification Search

USPC ..... 166/227, 230, 236, 99, 162, 265, 311, 166/228; 175/312, 314, 57; 210/130, 418, 210/420, 434, 459, 461

See application file for complete search history.

(56) References Cited

U.S. PATENT DOCUMENTS 2,771,141 A 11/1956 Lewis
2,915,127 A 12/1959 Abendroth (Continued)

FOREIGN PATENT DOCUMENTS

CA 2489051 6/2005
GB 2272923 1/1994

(Continued)

OTHER PUBLICATIONS

M-I, LLC v. *Chad Lee Stelly, et al.*, In the United States District Court for the Southern District of Texas, Houston Division, C.A. No. 4:09-CV-01552, Third Amended Complaint (Exhibits A-G were designated Attorney Eyes Only at time of filing and have been removed), Sep. 7, 2010.

(Continued)

*Primary Examiner* — David Bagnell
*Assistant Examiner* — Taras P Bemko
(74) *Attorney, Agent, or Firm* — Haynes and Boone, LLP

(57) ABSTRACT

Disclosed is a downhole well filter (800) and method of use in a tubing string with a power head (704) for creating reverse flow. The filter assembly includes an inner pipe (820) into which fluid flow is directed. The inner pipe is positioned within a cylindrical screen member (830). The well fluid flows through the screen member and debris from the fluid is deposited in the annulus (832) between the inner pipe and screen member. The screen member has a cap (860) at its upper end to prevent fluid from escaping from the upper end of the screen member. The cap may have a pop off valve (870) so fluid can escape from the screen member when the screen becomes clogged with debris or pressure builds within the screen member.

23 Claims, 13 Drawing Sheets

(51) Int. Cl.

| | |
|---|---|
| ***E21B 21/10*** | (2006.01) |
| ***E21B 21/12*** | (2006.01) |
| ***E21B 37/00*** | (2006.01) |
| ***E21B 41/00*** | (2006.01) |
| *E21B 34/00* | (2006.01) |

(56) References Cited

U.S. PATENT DOCUMENTS

| | | | | |
|---|---|---|---|---|
| 3,023,810 | A | 3/1962 | Anderson | |
| 3,056,459 | A | 10/1962 | Williams | |
| 3,120,872 | A | 2/1964 | Anderson | |
| 3,382,925 | A | 5/1968 | Jennings | |
| 4,059,155 | A | 11/1977 | Greer | |
| 4,276,931 | A | 7/1981 | Murray | |
| 4,857,175 | A | 8/1989 | Spinnler | |
| 5,176,208 | A | 1/1993 | Lalande | |
| 5,402,850 | A | 4/1995 | Lalande | |
| 5,944,100 | A | 8/1999 | Hipp | |
| 6,158,510 | A * | 12/2000 | Bacon et al. | 166/272.7 |
| 6,176,311 | B1 | 1/2001 | Ryan | |
| 6,189,617 | B1 | 2/2001 | Sorhus et al. | |
| 6,250,387 | B1 | 6/2001 | Carmichael et al. | |
| 6,276,452 | B1 | 8/2001 | Davis | |
| 6,341,653 | B1 | 1/2002 | Firmaniuk | |
| 6,523,612 | B2 | 2/2003 | Reynolds | |
| 6,530,429 | B2 | 3/2003 | Howlett | |
| 6,962,197 | B2 | 11/2005 | Khomynets | |
| 7,383,881 | B2 | 6/2008 | Telfer | |
| 7,472,745 | B2 | 1/2009 | Lynde | |
| 7,610,957 | B2 | 11/2009 | Davis et al. | |
| 7,789,154 | B2 | 9/2010 | Davis | |
| 7,861,772 | B2 | 1/2011 | Blair | |
| 7,870,897 | B2 | 1/2011 | Telfer | |
| 8,132,625 | B2 | 3/2012 | Anderson | |
| 8,225,859 | B1 | 7/2012 | Moidel et al. | |
| 8,257,585 | B2 | 9/2012 | Davis et al. | |
| 8,584,744 | B2 | 11/2013 | Soni et al. | |
| 8,672,025 | B2 | 3/2014 | Wolf et al. | |
| 2002/0134554 | A1 | 9/2002 | Schrenkel | |
| 2006/0086507 | A1 | 4/2006 | Surjaatmadja et al. | |
| 2006/0102534 | A1* | 5/2006 | Faria | 210/130 |
| 2007/0272404 | A1 | 11/2007 | Lynde | |
| 2008/0209710 | A1* | 9/2008 | Ferguson et al. | 29/447 |
| 2009/0032247 | A1 | 2/2009 | Davis | |
| 2009/0126933 | A1 | 5/2009 | Telfer | |
| 2009/0200012 | A1 | 8/2009 | Davis et al. | |
| 2010/0101798 | A1 | 4/2010 | Simpson et al. | |
| 2010/0181064 | A1 | 7/2010 | Knobloch et al. | |
| 2010/0243258 | A1 | 9/2010 | Fishbeck et al. | |
| 2010/0282472 | A1 | 11/2010 | Anderson | |
| 2010/0288485 | A1 | 11/2010 | Blair | |
| 2011/0024119 | A1 | 2/2011 | Wolf et al. | |
| 2012/0152522 | A1 | 6/2012 | Lynde | |
| 2012/0292047 | A1 | 11/2012 | Knobloch et al. | |
| 2012/0298369 | A1 | 11/2012 | Knobloch et al. | |
| 2013/0025865 | A1 | 1/2013 | Knobloch et al. | |

FOREIGN PATENT DOCUMENTS

| | | |
|---|---|---|
| GB | 2323111 | 9/1998 |
| GB | 2331536 | 5/1999 |
| GB | 2331536 A | 5/1999 |
| GB | 2346401 | 9/2000 |
| GB | 2341405 B | 11/2002 |
| GB | 2342666 | 8/2003 |
| WO | WO2008104177 A1 | 9/2008 |
| WO | WO2011028448 A2 | 3/2011 |

OTHER PUBLICATIONS

*M-I, LLC* v. *Chad Lee Stelly, et al.*, In the United States District Court for the Southern District of Texas, Houston Division, C.A. No. 4:09-CV-01552, Answer and Counterclaims to Plaintiffs Third Amended Complaint, Jan. 28, 2011.

*M-I, LLC* v. *Chad Lee Stelly, et al.*, In the United States District Court for the Southern District of Texas, Houston Division, C.A. No. 4:09-CV-01552, Order of Dismissal with Prejudice, Jun. 28, 2012.

MI SWACO, 2008 Catalog Specialized Tools, 2008, pp. 1-59, M-I L.L.C., Houston, Texas.

International Search Report for PCT/US2011/021921 mailed Apr. 1, 2012.

Inquiry Under The Substantive Examination dated Feb. 19, 2014 from The Federal Institute of Industrial Property for Application No. 2012134086/03(054291).

International Search Report dated Jan. 4, 2012 for PCT/US2011/021899.

Written Opinion dated Jan. 4, 2012 for PCT/US2011/021899.

International Search Report dated Feb. 8, 2012 for Application No. PCT/US2011/021926.

Written Opinion dated Feb. 8, 2012 for Application No. PCT/US2011/021926.

Canadian Search Report dated Aug. 27, 2013 for Application No. 2787145.

The First Office Action, The State Intellectual Property Office of the People's Republic of China, Application No. 201180006646.5, Issuing No. 2014033101039820, Dated Apr. 3, 2014, 8 pages.

Chinese Office Action dated Jan. 19, 2015 for Application No. 201180006646.5.

Canadian Office Action dated Aug. 27, 2013 for Application No. 2787141.

Canadian Office Action dated Jul. 29, 2013 for Application No. 2782660.

Chinese Office Action dated Apr. 3, 2014 for Application No. 201180006646.5.

Chinese Office Action dated Mar. 28, 2014 for Application No. 201180006653.5.

International Search Report for PCT/US2011/021899 mailed Jan. 4, 2012.

International Search Report for PCT/US2011/021926 mailed Jan. 4, 2012.

Office Action issued Jul. 14, 2014 regarding Mexican Application No. MX/a/2012/008465.

Patent Examination Report No. 1, issued Sep. 15, 2014 in Australian Application No. 2011207233.

Columbian Patent Office Action No. 13424 dated Jul. 30, 2013 for Application No. 12-139991.

Schlumberger Oilfield Glossary entries for "breakout tongs", "chain tongs", "joint", "makup tongs", and "tongs"; accessed Nov. 14, 2014 via www.glossary.oilfield.slb.com.

Written Opinion dated Aug. 2, 2012 for Application No. PCT/US2011/021926.

Letter from Trinidad and Tobago Technical Examiner dated Dec. 1, 2014 for Application No. TT/A/2012/00105.

Patent Examination Report No. 1, issued Sep. 10, 2014 in Australian Application No. 2011207241.

* cited by examiner

WELLBORE FILTER SCREEN AND RELATED METHODS OF USE

CROSS REFERENCE TO RELATED APPLICATIONS

This application claims priority from U.S. Provisional Patent Application No. 61/296,878, filed Jan. 20, 2010, entitled "Wellbore Filter Screen and Related Methods of Use," which is hereby incorporated by reference in its entirety.

BACKGROUND

Technical Field

The present inventions generally relate to enhanced and improved wellbore debris clean out tools and related methods of use. Generally, the tools of the present inventions are connected to a tubing string, such as, a drill string, for use in a downhole well environment to remove debris from the well.

Well operations, such as milling out a tool or pipe in a wellbore or frac operation, create debris that needs to be collected and removed from the well. For example, a bottom-hole assembly with a mill is made up with a debris collection tool. Debris collection tools are sometimes referred to as junk baskets, collector baskets or sand screens. There are a variety of different collection tools that operate on different principles. However, in general, these various tools have a common objective of separating circulating fluid from the cuttings and/or other debris that is present in the wellbore. In some tools, reverse circulation is created at the lower end of the tubing string and is used to circulate the debris into the collection tool. Reverse circulation is generally created by using a tool, sometimes referred to as a power head, to direct flow laden with cuttings and/or particulate material into a debris removal assembly.

Exemplary, non-limiting embodiments and/or disclosures of junk bailing apparatuses and vacuum apparatuses are disclosed in: U.S. Pat. No. 2,915,127; U.S. Pat. No. 2,771,141; U.S. Pat. No. 2,915,127; U.S. Pat. No. 3,023,810; U.S. Pat. No. 3,382,925; U.S. Pat. No. 4,059,155; U.S. Pat. No. 5,176,208; U.S. Pat. No. 5,402,850; U.S. Pat. No. 5,944,100; U.S. Pat. No. 6,176,311; U.S. Pat. No. 6,276,452; U.S. Pat. No. 6,341,653; U.S. Pat. No. 6,962,197; U.S. Pat. No. 7,472,745; U.S. 2007/0272404A1; and U.S. 2009/0126933A1, the contents of which are hereby incorporated by reference for all purposes, as if they were presented herein in their entirety. However, the art field is still in search of satisfactory tools to clean debris from a well.

SUMMARY OF THE INVENTIONS

In general, various embodiments of the present inventions comprise: a power head comprising a central flow passage, at least one eductor with a flow path parallel to the central flow passage, and at least one vent port. The valve is capable of directing flow through the eductor and opening the vent port, allowing flow through the eductor and into the annulus. The eductor is positioned to create an area of low pressure to generate reverse circulation into a debris collection assembly. The debris collection tool includes improved knock-out and filter assemblies.

These and other features and advantages of the inventions will be apparent to those skilled in the art from the following detailed description of a preferred embodiment, taken together with the accompanying figures and claims.

BRIEF DESCRIPTION OF THE FIGURES

All figures of the present inventions are not drawn to scale unless otherwise indicated. Understanding that these drawings depict only typical embodiments of the inventions and are, therefore, not to be considered limiting of their scope, the inventions will be described with additional specificity and detail through the use of the accompanying drawings in which.

DETAILED DESCRIPTION OF THE INVENTIONS

Figure 1:
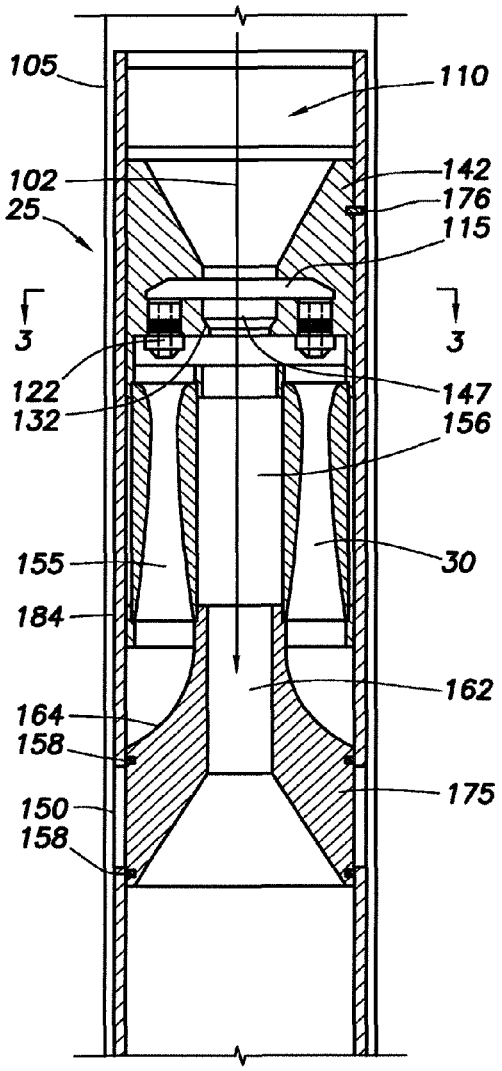
FIG. 1 is a sectional view of an embodiment of the power head of the present inventions in a closed position.

The particulars shown herein are by way of example and for purposes of illustrative discussion of the preferred embodiments of the present inventions only and are presented in the cause of providing what is believed to be the most useful and readily understood description of the principles and conceptual aspects of various embodiments of the inventions. In this regard, no attempt is made to show structural details of the inventions in more detail than is necessary for the fundamental understanding of the inventions, the description taken with the drawings making apparent to those skilled in the art how the several forms of the inventions may be embodied in practice.

The following definitions and explanations are not meant and intended to be controlling in any future construction unless clearly and unambiguously modified in the following description. In cases where the construction of the term would render it meaningless or essentially meaningless, the definition should be taken from Webster's Dictionary, 3$^{rd}$ Edition. Definitions and/or interpretations should not be incorporated from other patent applications, patents, or publications, related or not, unless specifically stated in this specification or if the incorporation is necessary for maintaining validity.

As used herein, the term "attached," or any conjugation thereof describes and refers the at least partial connection of two items.

As used herein, the term "integral" means and refers to lacking nothing essential after assembly.

As used herein, the term "fluid" is a continuous, amorphous substance whose molecules move freely past one another and that has the tendency to assume the shape of its container, for example, a liquid or a gas.

Other than in the operating examples, or where otherwise indicated, all numbers expressing quantities of components used herein are to be understood as modified in all instances by the term "about."

As used herein, an "eductor" is a device typically having a nozzle with an input port for flowing fluid through the device to an output port and for creating a suction to draw fluid into a suction port to mix with the fluid flowing between the input and output. Eductors include, for example, jet pumps and Venturi pumps. "Eductor axis" means the center line of the nozzle.

As used herein, "debris catcher" is a device for separating solids from wellbore fluids and includes screens and baskets.

Various embodiments of the present inventions generally provide for enhanced differential pressure power head. In various further embodiments, a differential power head of the present inventions can be used with a variety of drilling accessories and/or modular drilling accessories. In an embodiment, a differential pressure power head of the present inventions is associated with a wellbore clean out tool, such as, not by means of limitation, a junk basket, filter screen, and/or the like. A differential pressure is created by reverse circulated flow from the inner diameter of the tool and/or production pipe rather than by operation of flow from the outer diameter of the production pipe and/or wellbore or casing. The flow is created, at least in part, from the pressure differential and the Venturi effect. Various embodiments of the present inventions maximize the pressure from an eductor through an inner pipe.

Figure 2:
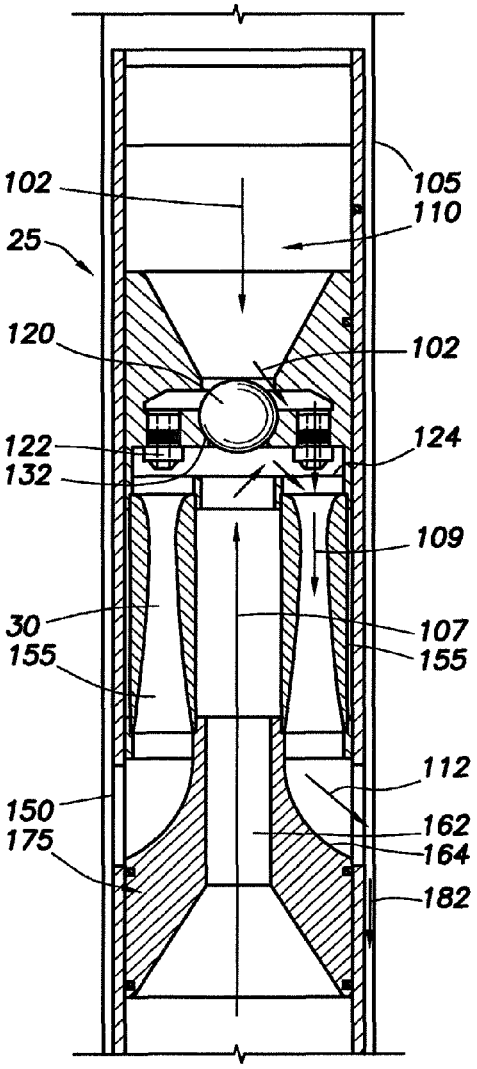
FIG. 2 is a sectional view of the embodiment of FIG. 1 in an open position.
Figure 3:
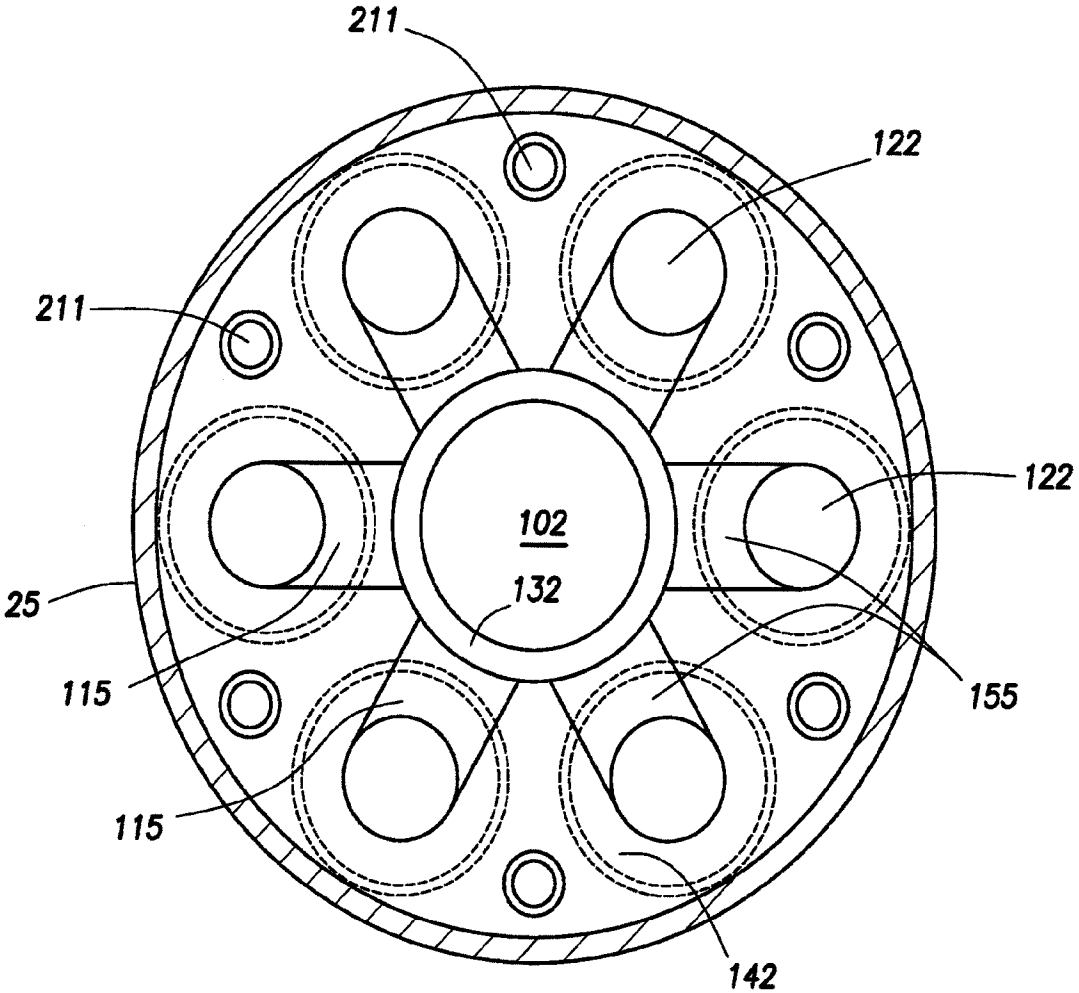
FIG. 3 is a sectional view taken on line A-A of FIG. 3.
Figure 4:
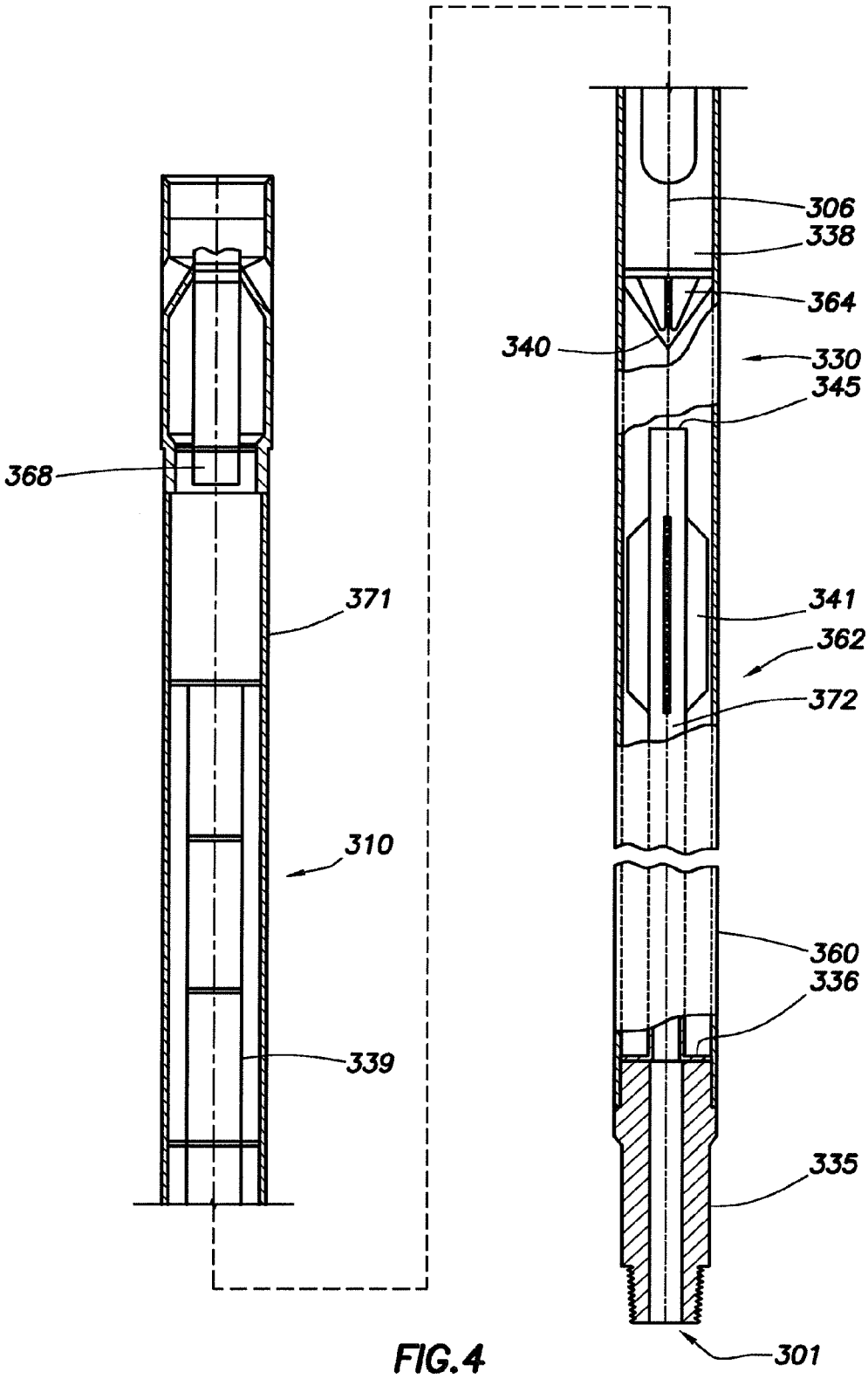
FIG. 4 is a sectional view of a debris collection portion of the present inventions capable of use with power head embodiments of the present inventions.

Referring now to the drawings wherein like reference characters are utilized throughout the several figures, there is illustrated, in FIGS. 1-3, an embodiment of a power head 110 of the present inventions disposed in a subterranean wellbore 105. In FIG. 1, the power head 110 is illustrated in the closed position and, in FIG. 2, it is illustrated in the open position. Alternative embodiments of a power head 110 are capable of comprising various other portions or segments as may be required for a particular drilling scheme or drilling procedure. In various embodiments, further drill string subs or parts are connected as well, such as an upper sub (an example of which is shown in FIG. 4).

In various embodiments, power head 110 comprises a tubular member 25 which defines an axially extending flow path 102 and vent ports 150 in the wall of the tubular member 25. Tubular member 25 has means, such as threads, on its ends for connecting the power head in fluid communication in a tubing string. The power head 110 further comprises a valve assembly 30 located in the tubular member 25 to axially slide therein between an open position and a closed position. In general, when the closed position vent ports 150 are blocked, there is no communication between the interior of the power head and the tubing annulus of the wellbore 105. In the open position, the vent ports 150 are open.

The body of the valve assembly 30 comprises an upper member 142, at least one eductor 155 and a deflector base 175. Valve assembly 30 has a spherical actuator ball valve seat 132 surrounding axially extending passageway 156. It is noted that the valve seat 132 is downstream of bypass port line 115 and upstream of the suction chamber 124. Eductor jet nozzles 122 are removably mounted (threaded) into the upper member 142 with eductor tubes 155 aligned with the eductor jet nozzles 122. The open space below the nozzles forms a suction chamber 124. In the preferred embodiment, six eductors are present, but it is only necessary to have at least one eductor for the power head to function. As illustrated, the eductors utilize not only a smooth convergent profile but also in the preferred embodiment the convergent profile is combined with a smooth divergent profile. These profiles are advantageous with well fluids containing solids. Deflector base 175 has an axially extending fluid flow passageway 162 and a tapered upper surface 164. Deflector base is mounted to axially slide or shift in tubular member 25 with the upper member 142. In FIG. 1, the deflector base 175 is shown in the closed position with flow through the ports 150 blocked and flow through eductor tubes 155 blocked. A pair of axially spaced seals 158 is mounted in the deflector base 175 to seal with the interior wall of the tubular member 25 to isolate vent ports 150 from fluid flow path 102. In various embodiments, at least a portion of eductor jet nozzles 122 is coated.

The eductor tubes 155 are clamped between the upper member 142 and deflector base 175 by bolts 211 (illustrated in FIG. 3) extending between the base and upper member. In this embodiment, the eductors can be easily removed for service. In addition, the power head can be customized for the particular application by changing the length and shape of the eductors and nozzles. The assembly of upper member 142, eductors tubes 155 and deflector base 175 can be releasably held in place in the tubular member 25, in the closed or open positions by shear pins 176 or detents (not illustrated) or the like. In various embodiments, valve assembly 30 forms an interference fit in the tubular member 25.

Bypass port lines 115 may generally be in an orientation extending from the interior flow path 102 to eductor jet nozzles 122. In an embodiment, bypass port 115 opens at about a ninety (90) degree angle from the fluid pathway. In an alternate embodiment, the bypass ports open at about a 120 degree angle from the fluid pathway. In an alternate embodiment, the bypass ports open at about a 135 degree angle from the fluid pathway. In an alternate embodiment, the bypass ports open at about a 150 degree angle from the fluid pathway. In an alternate embodiment, the bypass ports open at an angle less than about a 150 degree angle from the fluid pathway. Generally, any angle not overly impeding the fluid pathway is acceptable.

Valve seat 132 is adapted to receive an actuation ball or ball-shaped valve element 120 (shown in FIG. 2). In various embodiments, the ball-shaped valve element 120 is released from the well head above power head 110 into the fluid pathway and into inner axial passageway 156. It is understood that other shaped valve element could be used, it only being important that the valve element mate with the seat to block flow through the seat. Commonly, ball 120 is released from or about the surface. However, other mechanisms for storing and/or releasing ball 120 are capable of use with varying embodiments of the present inventions, such as a shelf or perch above valve seat 132. When ball 120 is seated on valve seat 132, fluid pathway 147 through axial passageway 156 is blocked and fluid is pumped down the tubing string into the power head 110 which is diverted into bypass port lines 115 and through eductor jet nozzles 122. In various further embodiments, a shear pin 176 maintains power head either in a closed or an open position. In general, in the closed position there is no communication between the interior of the power head and the tubing annulus of the wellbore 105.

As explained, when ball 120 is seated on valve seat 132, well fluid flowing in the tubing string is blocked from flowing through axial passageway 156. As the fluid pressure builds up, valve assembly 30 shears pins 176 and shifts or is forced down to the open position illustrated in FIG. 2. This moves deflector base 175 below vent ports 150, opening the eductor discharge to the annulus of tubular member 25.

In the open position, well fluid is diverted into and through eductor jet nozzles 122. In various embodiments, the eductor tubes 155 and eductor jet nozzles 122 can take on many shapes, volumes and/or lengths. Well fluids flowing through the eductor jet nozzles 122 provide power for the eductors by increasing the velocity and lowering the pressure of the flowing well fluid. As a result, a partial vacuum is created in the suction chamber 124. The well fluid passes through the suction chamber, entraining the fluids in the suction chamber. Friction between the well fluids causes the suction chamber to be evacuated. This allows the lower pressure in the suction chamber to "pull" or pump additional fluid up into the suction chamber from the portion of the fluid passageway 162 below the ball valve 120. The passage of the pressurized fluid through the eductor jet nozzles 122, into the suction chamber 124 and through the eductors tubes 155 creates a suction in the suction chamber (Venturi effect), such that any well fluid in the tubing string below the power head will be drawn into the chamber along fluid passageway 162 and thence into the eductors tubes 155 along with the fluid from the eductor jet nozzles 122. The mixture then passes along fluid flow path or fluid pathway 109 through the smooth walled diverging taper of the eductors where the kinetic energy of the fluid is converted back to pressure. The combined fluid then leaves the eductor and is directed into the wellbore along flow path 112.

In various embodiments, there are one or more eductors arranged circumferentially surrounding fluid passageway 162. In alternate embodiments, there are multiple eductors arranged radially symmetrically around fluid passageway 162. In an embodiment, there are at least two (2) eductors surrounding fluid passageway 162. In an alternate embodiment, there are at least three (3) eductors circumferentially surrounding fluid passageway 162. In an alternate embodiment, there are at least four (4) eductors surrounding fluid passageway 162. In an alternate embodiment, there are at least five (5) eductors surrounding fluid passageway 162. In an alternate embodiment, there are at least six (6) jets surrounding fluid passageway 162. In an alternate embodiment, there are at least seven (7) eductors surrounding fluid passageway 162. In an alternate embodiment, there are at least eight (8) eductors surrounding fluid passageway 162. In general, any number of eductors can be used to optimize the vacuum effect and/or the eductor effect and/or the pressure differential effect.

In general, in a method of operation, and referring to FIG. 1, drilling fluid is circulated through power head 110 along fluid flow path 102. When power head 110 is in a closed position, drilling fluid flows from flow path 102 through flow passageway 162 to the bit or mill at the bottom of the string. During milling operations or when cutting and/or debris removal is desired, ball 120 is dropped to seat against valve seat 132 (as shown in FIG. 2). Continued pumping of drilling fluid increases the pressure in tubular member 25 wherein the valve assembly 30 is urged to slide downhole until eductor discharge is aligned with vent port 150 whereby the drilling fluid is allowed to flow into the annulus of the wellbore by redirecting the fluid flow path from flow path 102 to flow path 112. As described, flow through the eductor jet nozzles 122 and eductor tubes 155 causes fluids to flow up the tubing string from below the power head 110 along fluid flow pathway 102 and into the suction chamber 124.

In various embodiments, eductor tubes 155 are tapered. In various embodiments, an induced flow is possible through circulation and/or recirculation. In an embodiment, eductor tubes 155 are divergent to induce flow of drilling fluid. In an alternate embodiment, eductor tubes 155 are convergent to induce flow of drilling fluid. In an alternate embodiment, eductor tubes provide convergent and divergent surfaces to induce flow of drilling fluid. In an alternate embodiment, eductor tubes 155 have multiple regions of convergent and divergent flow to induce flow of drilling fluid. In general, regions of varying convergence and divergence can be used in an embodiment of the present inventions.

In various embodiments, drilling fluid flow path 109 along the eductor axis through eductor tubes 155 is substantially parallel to fluid flow path 102. In various alternate embodiments, drilling fluid flow through eductor tubes is about parallel to fluid flow path 102. In general, drilling fluid flow 109 through eductor tubes 155 is directionally related to fluid flow path 102.

At least a portion of the redirected drilling fluid flows at high pressure along fluid flow path 109 and generally decreases in pressure through suction chamber 124 into flow path 109. In general, the pressure in a fluid flow path of the present inventions is dependent upon the volume and/or surface area of the flow path. In general, pressure differential capable with various embodiments of the present inventions can be used to lift the debris and/or cuttings and/or other items.

FIG. 3 is an illustration of a cut of FIG. 2 along line 3-3. As can be seen, a plurality of bolts 211, jets 122 and eductor tubes 155 surround pathway 102.

FIG. 4 illustrates an embodiment of a debris collection assembly 330 to be used with a power head of the present inventions and comprises a knock-out 340, a tubular collection chamber or basket 360, and a lower sub (or nipple) 335 threaded onto the bottom of basket 360. A removable assembly 362, comprising faceplate or base 336, second or inner pipe 372, and stabilizers 341, is located in the collection chamber or basket 360. Removable inner pipe assembly 362 is held in place between lower sub 335 and basket 360. Inner pipe 372 has an opening 345 at its upper end through which fluid flows into the chamber 360. Inner pipe 372 preferably has an open end but may take other configurations, such as a plurality of openings about the upper end of the inner pipe. According to a feature of the present inventions, the lower sub can be detached and pipe assembly 362 removed to flush out the debris collected in the basket 360.

First chamber 338 and a screen cage 339 comprise an upper assembly 310 and are located above the second or inner pipe assembly 362. Further embodiments comprise a tubular passage 368 and/or extension portion 371. When the power head is in the open position (recirculation mode), fluid flows up into debris collection assembly 330 along fluid pathway 301 and into inner pipe 372. Commonly, the drilling fluid flowing into inner pipe 372 is laden with debris and/or cuttings that need to be separated from the drilling fluid. The drilling fluid passes up second inner pipe 372 and across knock-out 340. Knock-out 340 causes larger debris and/or cuttings to fall into collection chamber or basket 360. Fluid and smaller debris pass through the openings or passageways 364 in the knock-out 340. In one embodiment of a debris collection assembly 330 for use in conjunction with a milling operation, debris collection assembly 330 can be lengthened or repeated, depending upon the length of casing in which the wellbore operation is to be performed.

The drilling fluid will continue to flow up past debris collection assembly 330 along fluid pathway 306 into a power head of the present inventions. In various embodiments, the drilling fluid passes across a screen cage 339 to remove further debris and/or cuttings. In various embodiments, at least a portion of the cleaned drilling fluid will be circulated back into the wellbore for drilling operations.

Figure 5:
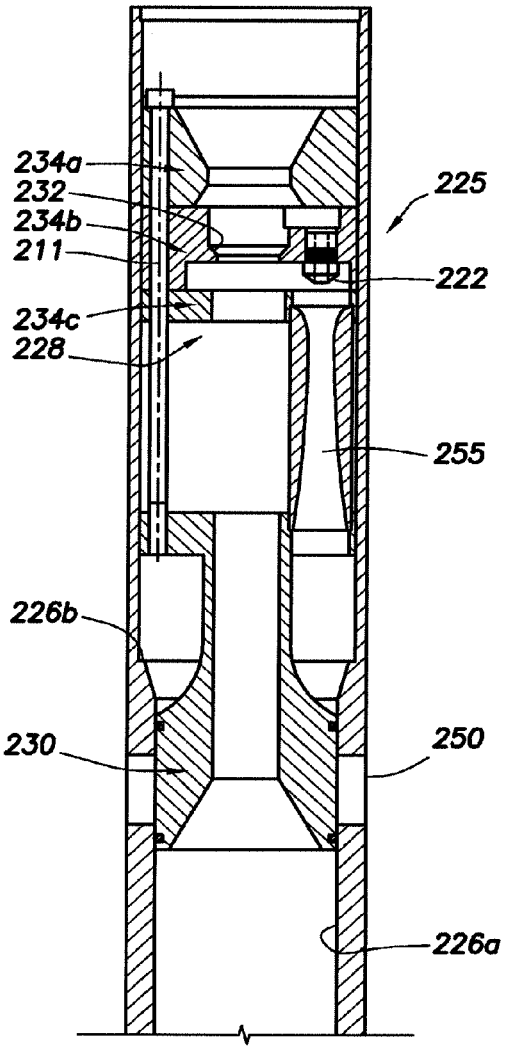
FIG. 5 is a sectional view of an alternate embodiment of a power head of the present inventions in a closed position.
Figure 6A:
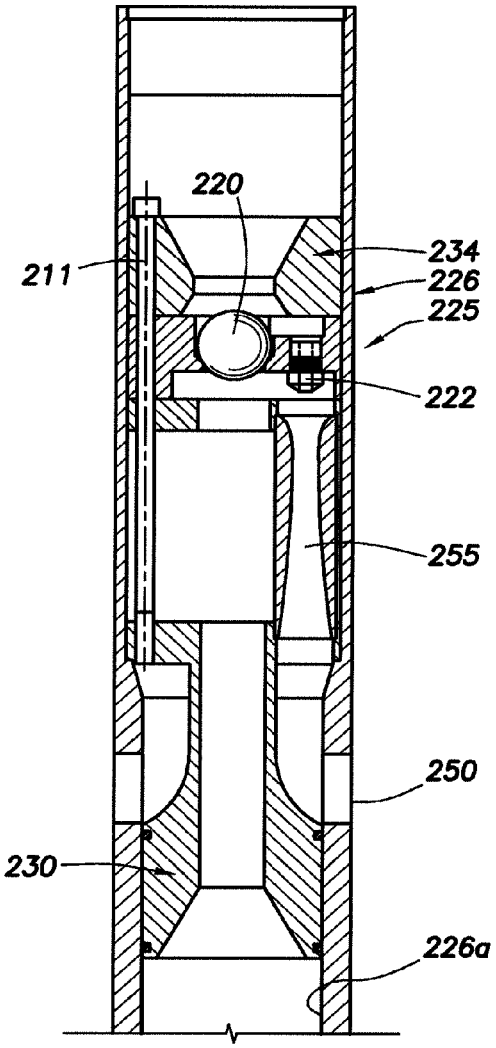
FIG. 6A is a sectional view of the power head of FIG. 5 in an open position.

FIGS. 5 and 6A illustrate an alternate embodiment of a power head 225, comprising housing 226 with a valve assembly 228 mounted therein. Housing 226 comprises an annular shoulder on 226*b*, a reduced internal diameter portion 226*a* with vent ports 250 therein. The valve assembly 228 comprises a three-piece upper member 234, eductors 255 and base deflector 230 held together by bolts 211. The upper member 234 comprises a ball guide 234*a*, valve section 234*b* and eductor stabilizer 234*c*. The ball guide 234*a* comprises valve seat 232 and mounts eductor jets 222. When the power head is moved to the open position, illustrated in FIG. 6A, shoulder 236 on deflector 230 engages reduced internal diameter portion 226*a* to properly align the valve assembly 228 with the vent ports 250.

Figure 6B:
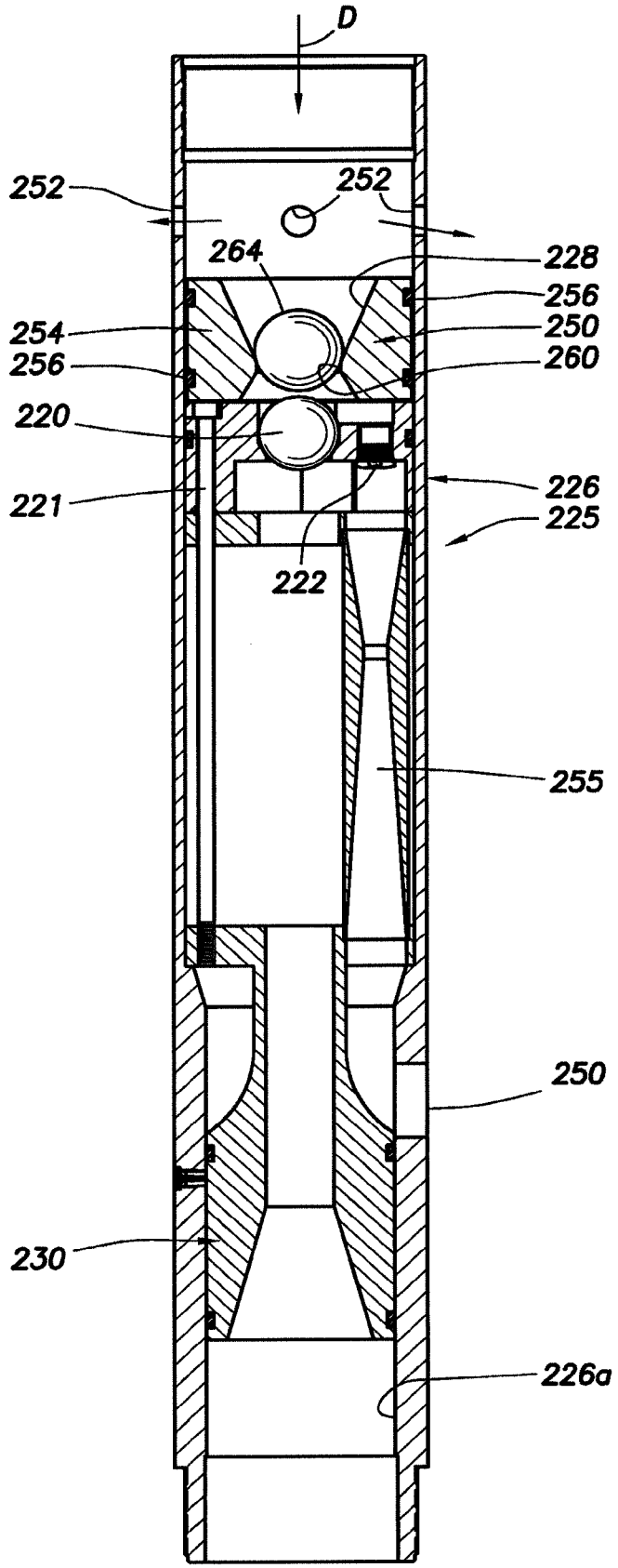
FIG. 6B is sectional view similar of an alternative embodiment of the power head of FIG. 6A, shown in the closed position.

In FIG. 6B, an alternative embodiment of power head 225 is illustrated in the actuated position. In this embodiment, a second valve assembly 250 is mounted in housing 226 above valve assembly 338 and bypass ports 252 are formed in the wall of housing 226. Valve assembly 250 comprises a valve body 254 and annular seals 256, sealing against the inner wall of housing 226. A valve seat 258 is formed on body 224 around axial passageway 260. The seat is of a size and shape to receive a valve element, in the illustrated embodiment, a ball 262. The passageway 260 is of a size and shape to allow ball 220 to pass therethrough. Body 254 is mounted in housing 226 to axially slide in the forward and reverse direction of arrow D. In use, the second valve assembly can be placed in the well in the run position (not shown), i.e., with valve body 254 raised to a position blocking flow through ports 252. A shear pin or the like can be used to hold valve body 254 in the raised position. When it is necessary to block flow through the power head 225 and open ports 252, a large valve element (actuator ball 264) is pumped onto seat 258 and valve body 254 is forced to slide down to the actuated position illustrated in FIG. 6B. The valve assembly 250 can be used circulate well fluids either into or out of the tubing string through ports 252. Valve assembly 250 allows the power head 225 to be lowered into the well in the open condition and then disabled by actuating valve assembly 250.

Figure 7:
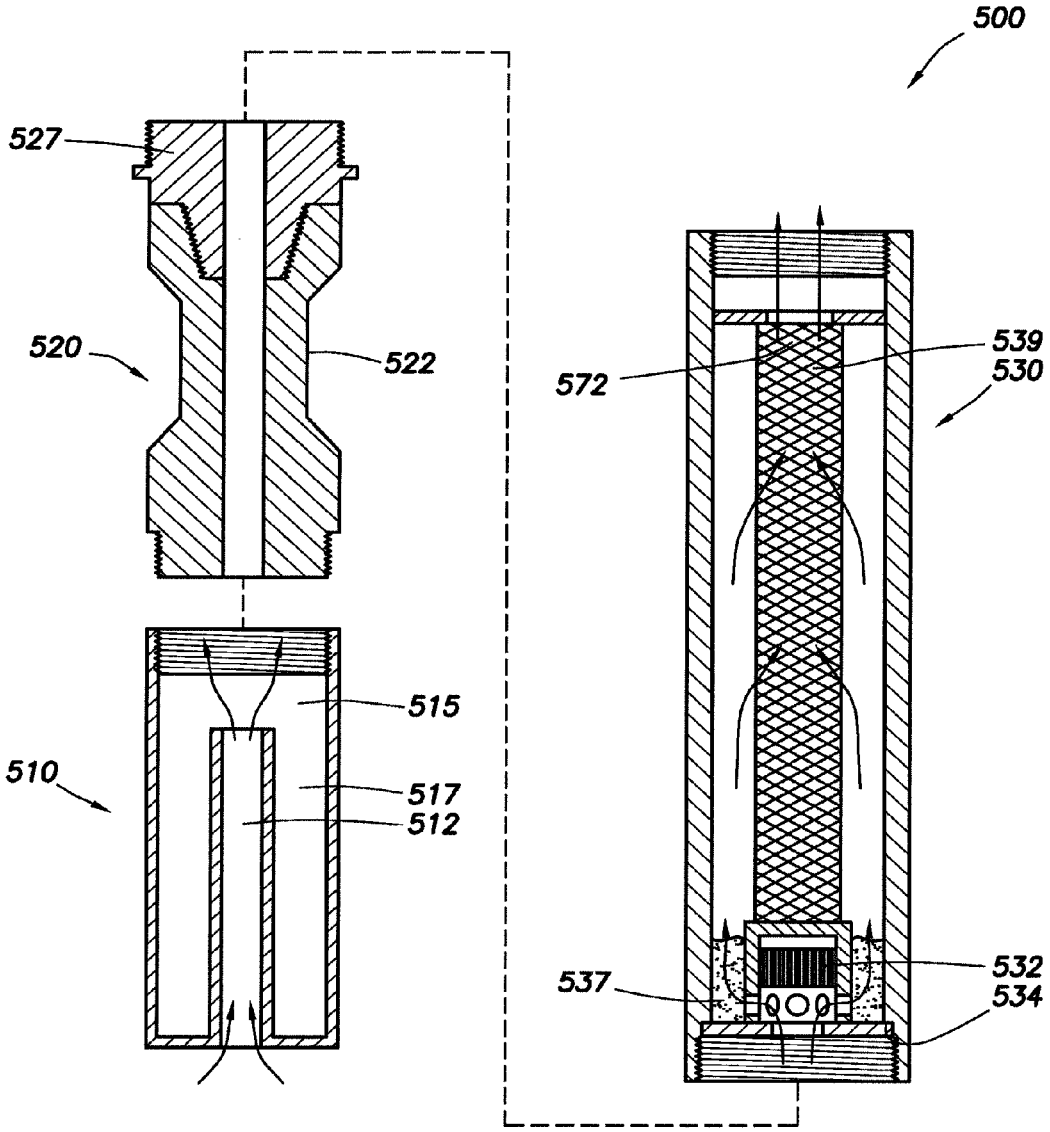
FIG. 7 is a sectional view of an alternative embodiment of a debris collection portion of the present inventions.

FIG. 7 is a sectional expanded view of an alternate embodiment of a modular debris collection apparatus 500 with a check valve 532 capable of use with various embodiments of the present invention. In general, a first debris collection portion 510, comprising an inner pipe 512 and an expanded region 515, is used to remove larger debris from the drilling fluid. As drilling fluid flows up, inner pipe 512 expands into region 515 and releases a portion of its accumulated debris into collection chamber 517.

Eventually, collection chamber 517 fills and requires cleaning. Various embodiments of the present invention utilize a handling sub 520 with an indented portion 522 to be grasped by existing tongs and/or tools on the drill site. As such, sub 520 can be disconnected from a drill string and collection chamber 517 separated and emptied, thus saving valuable drill time.

A unique sand sub 530 for removing particulate matter, such as, but not limited to, sand and proppant, can be attached to various embodiments of the present invention for enhancing well cleanout procedures. Sand sub 530 generally comprises a mesh 539, an inner pipe 572, a debris collection chamber 537, a base plate 534, and a check valve 532. Check valve 532 can be constructed to be open during reverse flow and closed during normal circulation. Various further embodiments comprise ports (not shown) to allow operation during normal circulation.

Figure 8:
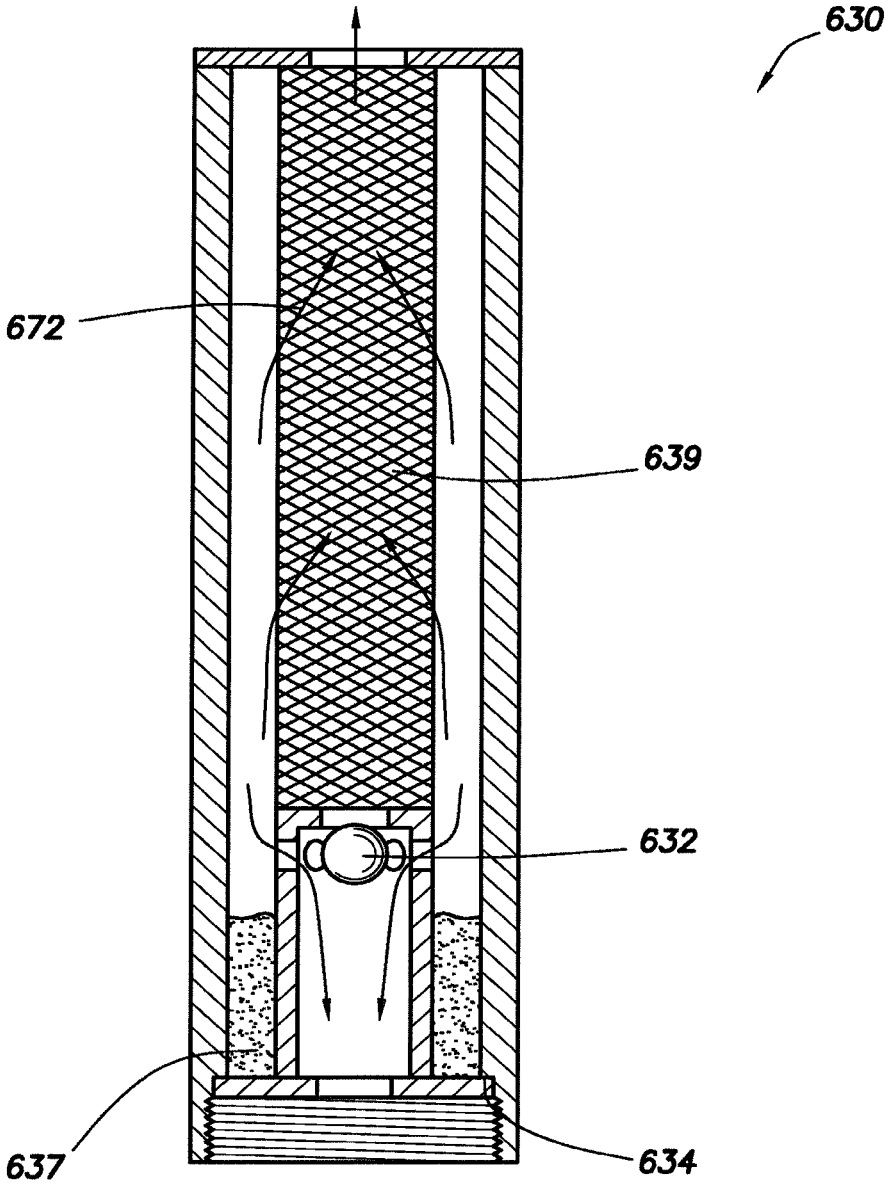
FIG. 8 is a sectional view illustration of an alternative embodiment of a check valve portion of the debris collection portion of FIG. 7.

FIG. 8 is an illustration of an alternate check valve capable of use with various embodiments of a sand sub 630 of the present inventions, comprising an elongated debris collection chamber 637, a check valve 632, a mesh 639, an inner pipe 672 and a base plate 634. In general, fluid is selected to flow during circulation and/or reverse circulation around check valve 632.

Figure 9:
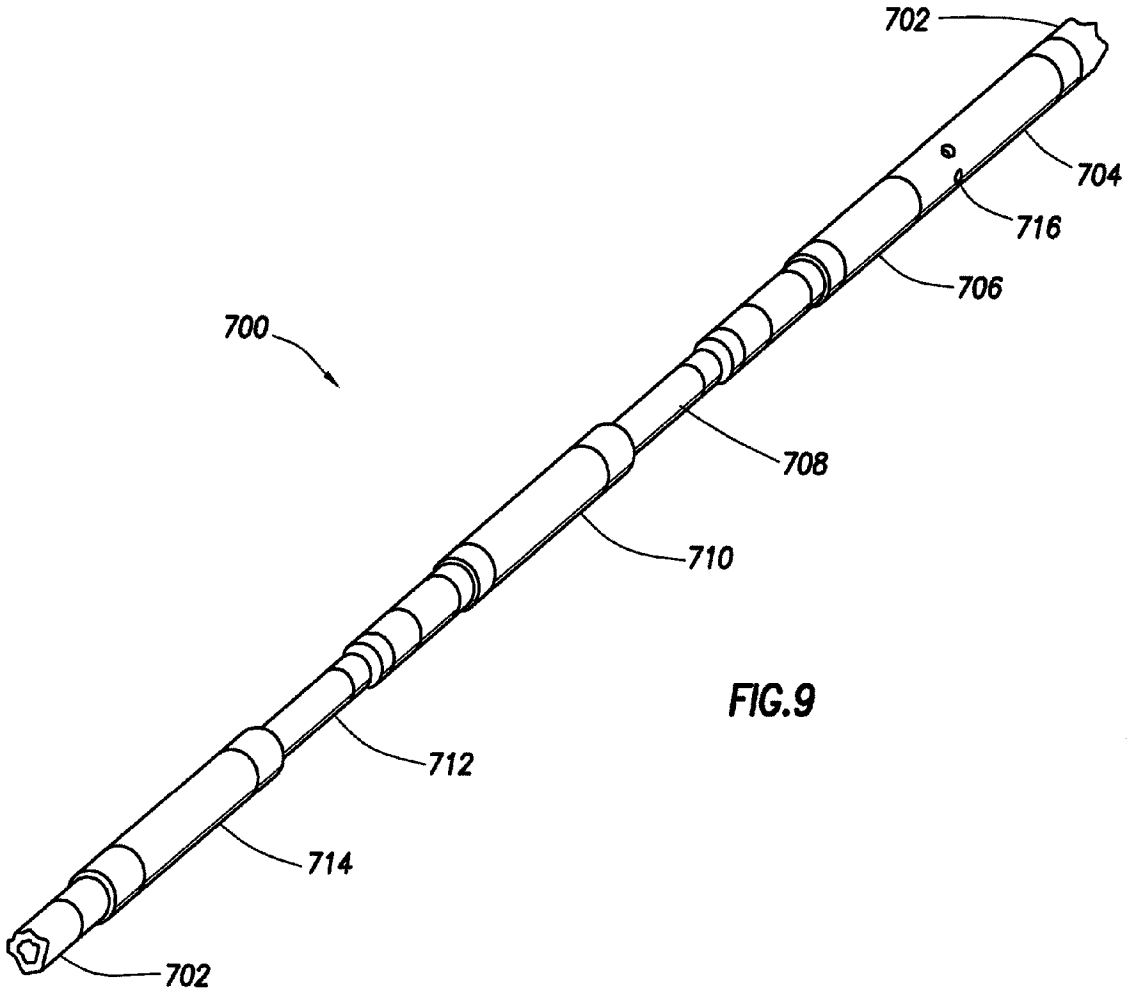
FIG. 9 is a perspective view of the power head of the present inventions assembled with a third alternative embodiment of the debris collection portion of the present inventions.
Figure 10:
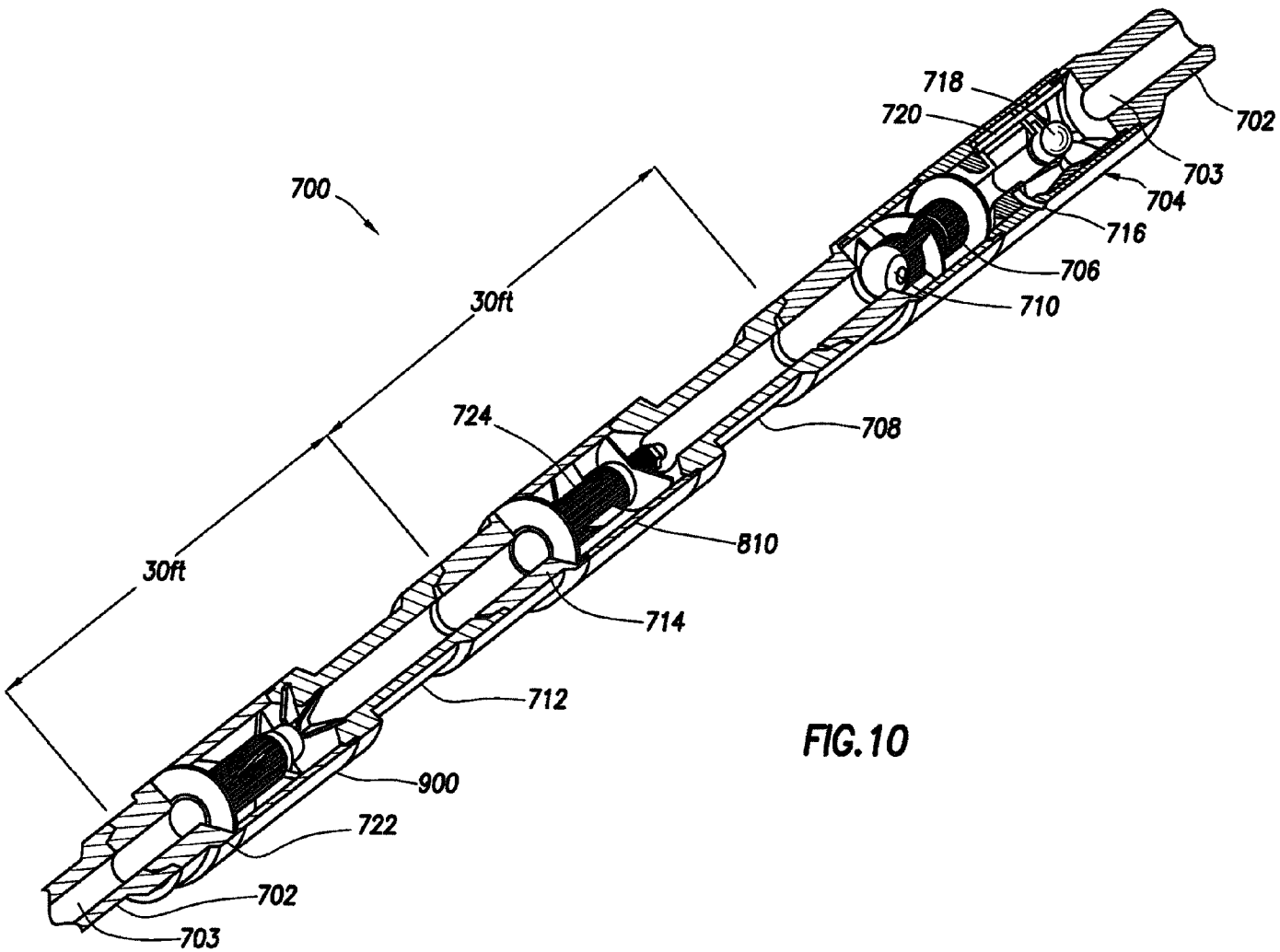
FIG. 10 is a sectional view of the assembly of FIG. 9.

A further alternative embodiment of the debris collection assembly 700 of the present inventions is illustrated, made up in a tubing string 702 (consisting of drill pipe), in FIGS. 9 and 10. Tubing string 702 has an internal passageway 703 communicating with the debris collection assembly. Debris collection assembly 700 comprises: power head assembly 704, drill pipe screen 706, upper handling section 708, screen assembly 800, lower handling section 712, and knock-out assembly 900. Nipples 710, 714 and 722 are included to adapt threads and close off the bottom of the assemblies. While in the illustrated configuration, assembly 700 includes, for example, only one of each component. It is envisioned that more than one knock-out screen could be assembled in series if needed. It should be noted that the handling sections are of the same configuration (size and shape) as the drill pipe allowing the handling sections of assembly 700 to be grasped and manipulated by the same tongs and/or tools on the drill rig or service rig as those used on the drill pipe. The handling sections have a length that, when assembled with one of the filter or knock-out assemblies, can be handled like a section of drill pipe. For example, the combined length of handling section 712 is selected such that when connected to knock-out assembly 900 and nipple 722, the resulting assembly is about 30 feet long, allowing it to be made up on the a pipe rack or retrieved from the well, placed on the pipe rack and disassembled and emptied without tying up rig equipment. Similarly, the combined length of handling sub or section 708 is selected such that when attached to the filter screen assembly 724 and nipple 712, the resulting assembly is about 30 feet long and can be handled as a single length of pipe. The same is true of the length of assembled power head tool 704 and drill pipe screen 706. The debris collection assembly 700 can have a 90 foot length, allowing the assembly to be handled like three sections of drill pipe.

Power head 704 can have any of the configurations described herein. Power head 704 is connected to a section of drill pipe 702 and its passageway 703. Discharge ports 716 are opened by flowing an actuation ball 718 onto a seat in the power head 704. Ball 718 also diverts flow from the drill pipe 702 through eductors 720 and out ports 716 into the annulus formed between the debris collection assembly 700 and the wellbore wall. The eductors 720 create a low pressure area which in turn causes well fluids to flow into the bottom of tubing string 702 and up passage 703 through knock-out assembly 900 and screen assembly 800. Debris is removed from the well fluid in the knock-out 900 and screen 800 assemblies.

Figure 11:
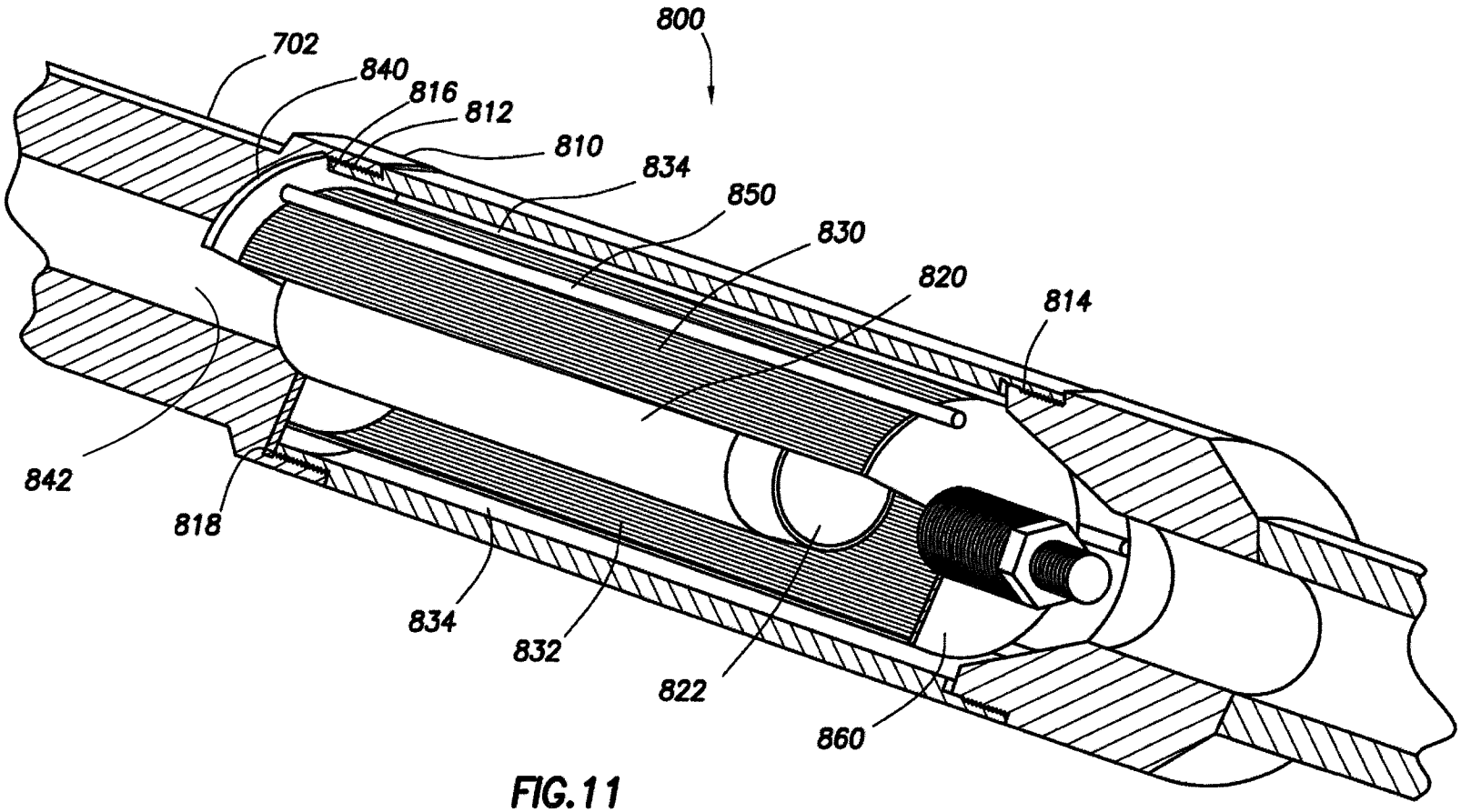
FIG. 11 is a sectional view of the filter portion of the assembly of FIG. 9.
Figure 13:
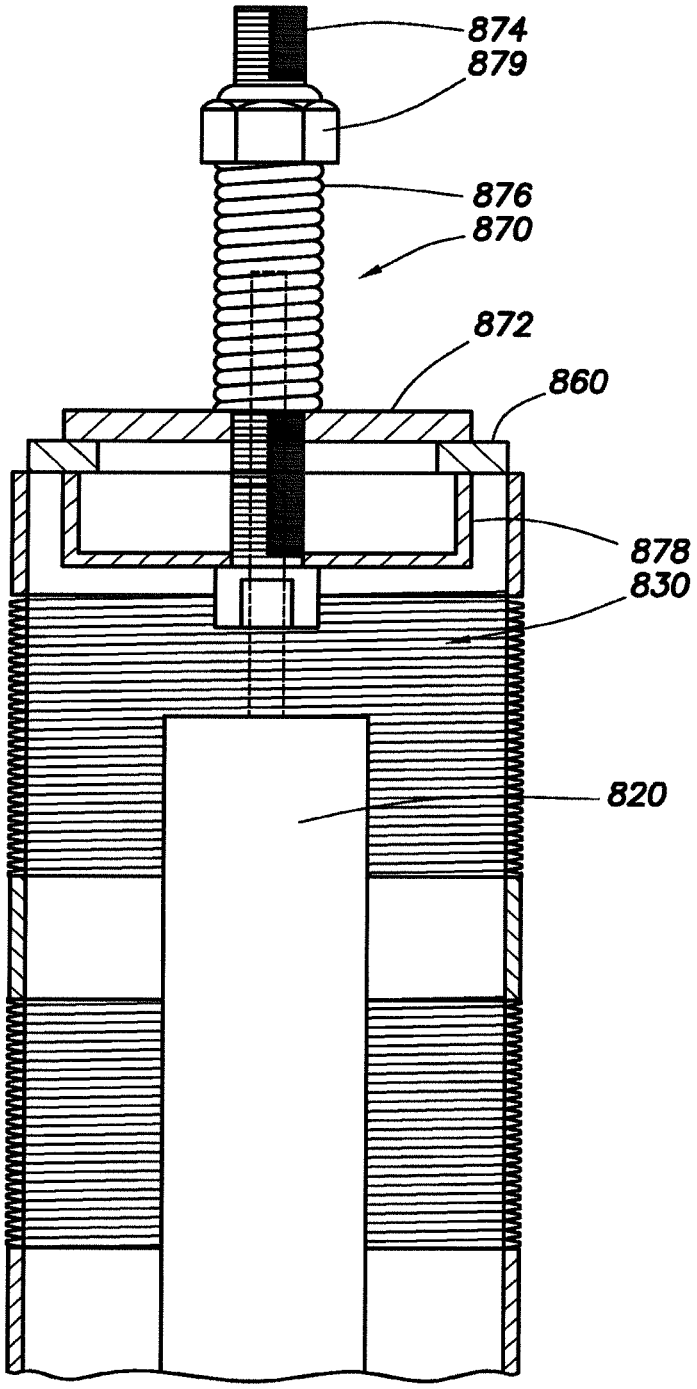
FIG. 13 is a sectional view of the valve in the filter portion of the present inventions.

Details of screen assembly 800 are illustrated in FIGS. 11 and 13. The screen assembly 800 comprises a cylindrical housing 810 which is externally threaded at its lower end 812 to connect with the lower handling section 712 and internally threaded at its upper end 814 to connect with upper handling section 708. In this embodiment, the nipple 714, shown in FIG. 10, is eliminated. A base 840 is mounted at the lower end of the screen assembly 800 and is held in place between opposed annular shoulders 816 and 818. The base 840 is in the shape of a flat washer with a central flow passage 842 extending there through. An inner velocity tube 820 is mounted on and extends axially from base 840. Inner velocity tube 820 has a cylindrical shape and of a size to fit around the perimeter of central flow passage 842. The upper end 822 of velocity tube 820 is open.

A cylindrical screen 830 extends from the base 840 and forms an annulus 832 around inner velocity tube 820. In the present embodiment, screen 830 is illustrated as a wire wound screen but it is envisioned that the other types of debris screens could be used. A second annulus 834 is formed between the housing 810 and screen 830. A cap 860 closes off the upper end of cylindrical screen 830. A plurality of axially extending spacers 850 are attached to the outside of screen 830 to provide support.

A pop off valve 870 is mounted in cap 860. Details of the pop off valve 870 are illustrated in FIG. 13. Pop off valve 870 comprises a valve element 872, a valve stem 874, a compression spring 876 and a valve cage 878. As illustrated, the spring 876 urges the valve element 872 against the cap 860 to close off the top of the filter 830. When the filter 830 becomes loaded with debris, fluid pressure inside the filter 830 will overcome the spring 876 and lift the valve element 872 away from the cap 860 allowing fluid to bypass the filter 830. As illustrated, the force exerted by spring 876 and valve element 872 can be adjusted by turning the nut 879 on the threaded stem 874.

Under normal operation, well fluids containing debris flow into the screen assembly 800 through tube 820. Flow entering the annulus 832 is filtered by flowing through the screen 830 and into the annulus 834. As well fluids are filtered, debris accumulates in the annulus 832, and the filter flow exits the screen assembly 800 via the upper handling section 708. According to a feature of the present invention, when the lower handling section 712 (nipple 714) is disconnected from the housing 810, the assembly of the base 840, tube 820 and screen 830 can be axially removed from the housing 810 for cleaning or repair.

Figure 12A:
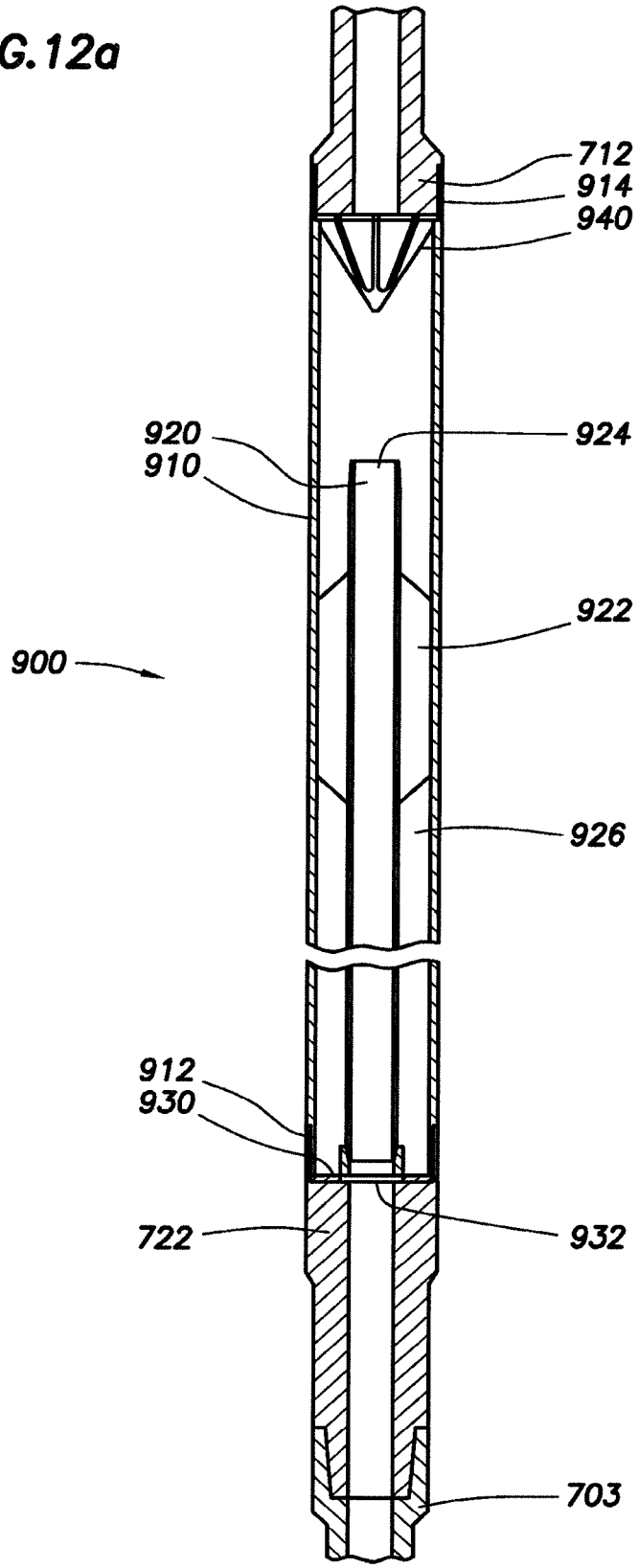
FIGS. 12 *a* and *b* are sectional views of embodiments of the knock-out portion of the assembly of FIG. 9.

Details of knock-out assembly 900 are illustrated in FIGS. 12 *a* and *b*. Knock-out assembly 900 comprises a cylindrical housing 910 which is externally threaded at its lower end 912 and internally threaded at its upper end 914. An inner velocity tube 920 extends axially from and is connected to base 930. Tube 920 creates a debris collecting annulus 926 with the interior of housing 910. Base 930 is mounted between opposed shoulders on the housing 910 and nipple 722. The stabilizers 922 are mounted on the outside of tube 920 to center it in the housing 910. A porous deflection cone (or "knockout") 940 is mounted above the opening end 924 of tube 920. Passageway 932 communicates with the interior of tube 920. In operation, well fluids enter the knock-out assembly 900, or are discharged from the velocity two 920 toward the deflection cone 940 where larger debris is deflected radially to fall back into the annulus 926. Knock-out assembly 900 can be simply removed by unthreading nipple 722.

Figure 12B:
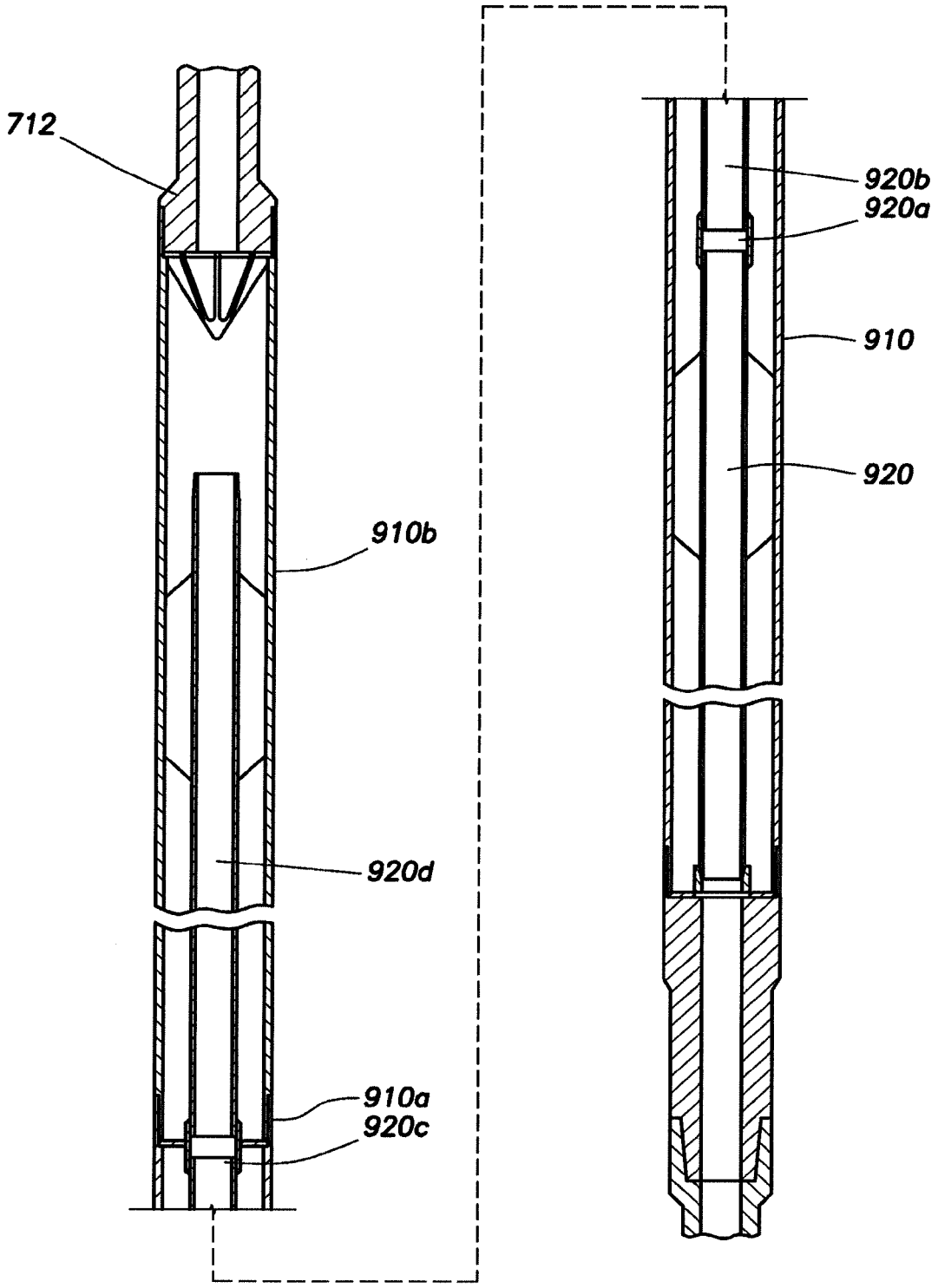

According to a particular feature the present invention, the screen and knock-out assemblies can be extended in length or multiple assemblies can be used in conjunction with one another, depending on the conditions present at a well site. If additional quantities of debris are anticipated, then the knock-out section can be extended in length. As illustrated in FIG. 12*b*, housing 910 uses a mating threads 910*a* to add a second housing section 910*b*. Velocity tube 920*d* is added to tube 920 by using two collars 920*a* and 920*c* in and a sort section of tube 920*b*. In this manner, one or more sections can be added to the knock-out assembly 900 to accommodate larger volumes of debris. In a similar manner, the screen assembly 800 can be extended as required.

In use, the nipples of the various assemblies can be connected and disconnected away from the well rig, such as at a pipe rack, utilizing power hand tools such as chain power tongs and pipe wrenches or horizontal bucking unit. For example, nipple 722 is attached or removed to assemble or dissemble knock-out tool 900 with power hand tools and does not require the use of the rig floor equipment. For example, when disassembly of knock-out tool is desired for cleaning, the makeup torque for the nipple can be broken out (or made up) as the tool is removed from (or inserted in) the well using the power tongs on the rig floor and the nipple removed and the knock-out tool cleaned on the pipe rack without tying up the rig. The same is true of nipple 714 and filter screen assembly 800. After placing the various tool assemblies in a drill string and lowering into a wellbore, the tools are used as described herein. When the tool assemblies are removed from the wellbore, they are uncoupled or disconnected from the tubing string utilizing the rig. As explained above, the assemblies are designed to be removed from the well like a section of pipe. A combined assembly of nipple 722, knock-out assembly 900 and handling sub 712 is removed as a unit from the string. The entire unit can then be placed away from the rig, such as, on a pipe rack or other location, thereby freeing the rig for other uses. Nipple 722 is then removed utilizing power hand tools rather than the rig equipment. The removable faceplate, inner tube and stabilizers are then easily cleaned. Similarly, the screen filter assembly and power head assemblies can be uncoupled from the drill or pipe string, removed to a pipe rack or other area, and then dissembled for cleaning. The terms "nipple" and "lower sub" and the like, as used herein, indicate a section of tubular having a flow passage therethrough and removably attachable to an end of a tool housing, such as, for example, nipples 714 and 722, and lower sub 301.

While particular embodiments of the inventions have been shown and described, numerous variations and alternate embodiments will occur to those skilled in the art. Accordingly, it is intended that the inventions be limited only in terms of the appended claims.

The inventions may be embodied in other specific forms without departing from the present inventions as the disclosed examples are only illustrative and not restrictive. The scope of the inventions is, therefore, indicated by the appended claims rather than by the foregoing description. All changes to the claims that come within the meaning and range of equivalency of the claims are to be embraced within their scope. Further, all published documents, patents and applications mentioned herein are hereby incorporated by reference, as if presented in their entirety.

What is claimed is:

1. A method for filtering debris from a well fluid, the method comprising the steps of:

flowing a debris-containing well fluid through a first inlet into a first elongated housing tool that has a first outlet;

flowing the debris-containing well fluid through a first inner tube extending within the first housing;

allowing the debris-containing well fluid to pass through a porous deflection cone while blocking a first portion of debris using the porous deflection cone;

accommodating the first portion of debris within a first annulus formed between the first inner tube and the first housing;

flowing the debris-containing well fluid through the first outlet of the first housing;

flowing the debris-containing well fluid through a second inlet into a second elongated tool housing, the second inlet being in fluid communication with the first outlet of the first housing;

flowing the debris-containing well fluid through a second inner tube;

flowing the debris-containing well fluid into a second annulus between the second inner tube and an elongated screen member;

flowing the well fluid through the screen member, thereby filtering the well fluid of at least another portion of the debris; and flowing the well fluid through a second housing outlet.

2. The method as in claim 1, further comprising a step of flowing the debris-containing well fluid through an outlet of the second inner tube positioned near an upper end of the screen member.

3. The method as in claim 2, further comprising a step of flowing the debris-containing well fluid along substantially the entire length of the second inner tube and then into the second annulus.

4. The method as in claim 1, further comprising a step of blocking fluid flow through one end of the screen member with a cap covering one end of the screen member.

5. The method as in claim 4, further comprising a step of later allowing fluid flow through the cap.

6. The method as in claim 5, further comprising a step of opening a valve positioned in the cap, thereby allowing fluid flow through the cap.

7. The method as in claim 5 wherein the cap comprises at least one bypass port and a pop off valve positioned to control fluid flow through the bypass port.

8. The method as in claim 1, further comprising a step of blocking flow at one end of the second annulus with a base plate.

9. The method as in claim 8, further comprising a step of connecting the base plate to the second inner tube and the screen member.

10. The method as in claim 1, further comprising a step of connecting the second tool housing to a tubing string.

11. The method as in claim 10, further comprising a steps of:

connecting the second elongated housing to a nipple capable of being manipulated by a power hand tool;

removing the nipple and the second elongated housing simultaneously from the drill string;

placing the nipple and the second elongated housing simultaneously on a tubing rack;

then removing the nipple from the second elongated housing utilizing a powered hand tool; and removing a cleaning subassembly from the second elongated housing.

12. The method as in claim 11 wherein the cleaning subassembly comprises the base plate, the second inner tube, and screen member.

13. The method as in claim 1, further comprising a step of connecting a power head tool to the tubing string above the second elongated tool housing.

14. The method as in claim 1, further comprising a step of directing downhole fluid flow within the tubing string into a wellbore annulus, then through the first inlet into the first elongated housing, the first inlet positioned at the downhole end of the first housing.

15. A wellbore tool for filtering debris from a well fluid and adapted to be lowered into a wellbore on a tubing string, the tool comprising:

a first elongated tool housing having a first interior passageway for flow of well fluids through the first housing, the first housing having a first inlet and a first outlet, the first housing adapted for connection in a tubing string;

a porous deflection cone positioned in the first housing for preventing a portion of debris from passing through the first elongated housing;

a first inner tube in fluid communication with the first inlet, the first inner tube positioned within the first housing and defining a first annulus between the first inner tube and the first housing for capturing the portion of debris prevented from passing through the first housing;

a second elongated tool housing having a second interior passageway for flow of well fluids through the second housing, the second housing having a second inlet that is in communication with the first outlet and a second outlet, the second housing adapted for connection in the tubing string;

an elongated screen member positioned in the second housing, defining a first second annulus between the second housing and the screen member; and a second inner tube in fluid communication with the second housing inlet, the second inner tube positioned within the screen member and defining a third annulus between the second inner tube and the screen member, one end of the second inner tube in fluid communication with the second housing inlet, the second inner tube for directing fluid flow from the second housing inlet into the second annulus, the third annulus for capturing debris from the fluid.

16. The tool as in claim 15 further comprising a base plate removably connected to one end of the second tool housing, the base plate attached to the second inner tube and screen member.

17. The tool as in claim 16 further comprising a removable subassembly comprised of at least the base plate, the second inner tube and the screen assembly, the subassembly capable of removal from the second tool housing utilizing a powered hand tool.

18. The tool as in claim 15 further comprising a cap positioned at one end of the screen member for blocking fluid flow through the end of the screen member.

19. The tool as in claim 18 further comprising a bypass port and bypass valve for allowing fluid flow to bypass flowing through a screen wall of the screen member.

20. The tool as in claim 19 wherein the bypass valve is operated by fluid pressure increase within the screen member.

21. The tool as in claim 15 wherein the second inner tube extends substantially the length of the screen member, the second inner tube having an opening positioned proximate an upper end of the screen assembly.

22. The tool as in claim 15 further comprising spacers for maintaining the screen member spaced from a wall of the second tool housing.

23. The tool as in claim 15 further comprising a nipple removable by power hand tools.

* * * * *